US008909072B2

(12) United States Patent
Takemura

(10) Patent No.: US 8,909,072 B2
(45) Date of Patent: Dec. 9, 2014

(54) IMAGE FORMING APPARATUS AND CONTROL METHOD THEREOF

(71) Applicant: Canon Kabushiki Kaisha, Tokyo (JP)

(72) Inventor: Taichi Takemura, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 72 days.

(21) Appl. No.: 13/711,498

(22) Filed: Dec. 11, 2012

(65) Prior Publication Data

US 2013/0156445 A1 Jun. 20, 2013

(30) Foreign Application Priority Data

Dec. 15, 2011 (JP) ..... 2011-275017

(51) Int. Cl.

| | |
|---|---|
| ***G03G 15/00*** | (2006.01) |
| ***G03G 15/20*** | (2006.01) |
| ***G03G 15/01*** | (2006.01) |
| ***G03G 13/20*** | (2006.01) |

(52) U.S. Cl.

CPC ..... *G03G 15/2039* (2013.01); *G03G 15/5062* (2013.01); *G03G 15/0189* (2013.01); *G03G 13/20* (2013.01)

USPC ..... 399/15; 399/45; 399/64

(58) Field of Classification Search

USPC ..... 399/15, 45, 64, 407; 356/402

See application file for complete search history.

(56) References Cited

U.S. PATENT DOCUMENTS

| | | | | |
|---|---|---|---|---|
| 5,864,408 | A * | 1/1999 | Kumashiro | 358/461 |
| 2002/0039208 | A1 * | 4/2002 | Honjo et al. | 358/514 |
| 2012/0154832 | A1 * | 6/2012 | Yokoyama et al. | 358/1.9 |
| 2012/0219306 | A1 * | 8/2012 | Shiomichi et al. | 399/15 |

FOREIGN PATENT DOCUMENTS

JP 2004-086013 A 3/2004

* cited by examiner

*Primary Examiner* — Francis Gray

(74) *Attorney, Agent, or Firm* — Canon USA Inc IP Division

(57) ABSTRACT

An image forming apparatus includes an image forming unit configured to form a measurement image on a recording sheet by using a color material, a fixing unit configured to fix the measurement image onto the recording sheet by heating the measurement image, a measurement unit configured to measure color values of the measurement image fixed on the recording sheet downstream of the fixing unit in a sheet conveyance direction of the recording sheet, a pressing member configured to press the recording sheet, on which the measurement image is formed, against the measurement unit, a selection unit configured to select a mode from among a first mode, in which the measurement image is measured with the pressing member pressing the recording sheet against the measurement unit, and a second mode, in which the measurement image is measured without the pressing member pressing the recording sheet against the measurement unit.

18 Claims, 6 Drawing Sheets

IMAGE FORMING APPARATUS AND CONTROL METHOD THEREOF

BACKGROUND OF THE INVENTION

1. Field of the Invention

The present invention relates to an image forming apparatus capable of measuring a measurement image formed on a recording sheet.

2. Description of the Related Art

In an image forming apparatus, the quality of an image (hereinafter, referred to as an "image quality") is determined based on graininess, in-plane uniformity, character quality, and color reproducibility (including color stability). In the recent spread of the multi-color image forming apparatus, the color reproducibility is sometimes referred to as the most material factor for determining the image quality.

Each person has a memory of colors (e.g., specifically, colors of human skin, blue sky, and metal) he expects based on his experience. The person will have uncomfortable feeling when seeing a color beyond a permissible range of the color he expects. Such colors are called "memory colors". The reproducibility of the memory colors are often expected when photographs are output.

A demand for good color reproducibility (including color stability) is increasing with respect to the image forming apparatus. For example, in addition to the photo-images, there are office users who have uncomfortable feeling of difference in colors between a document image on a monitor and an actual document, and graphic art users who pursuit the color reproducibility of a computer-generated (CG) image.

To satisfy the good color reproducibility demanded by the users, for example, Japanese Patent Application Laid-Open No. 2004-086013 discusses an image forming apparatus for scanning a measurement image (i.e., a patch image) formed on a recording sheet by using a measurement unit (i.e., a color sensor) provided in a conveyance path for conveying the recording sheet. With the image forming apparatus, density, gradation, and a tint can be reproduced to some extent such that feedback is given to process conditions such as an amount of exposure and a developing bias based on the scanning result of the patch image scanned by the color sensor.

When using a color management technique such as the International Color Consortium (ICC) profile, a measurement by white backing is a mainstream of the color management technique, and thus the International Organization for Standardization (ISO) 13655 defines regulations regarding the white backing. In the measurement by the white backing, the measurement is carried out such that a pressing member such as a white reference plate is pressed against a color sensor side from a back side of a recording sheet on which a patch image is formed to thereby measure the patch image with the color sensor. The measurement method can prevent the recording sheet from being fluttered while the recording sheet is conveyed and can keep a distance from the color sensor to the patch image on the recording sheet constant. Accordingly, a high precision measurement can be realized.

However, the image forming apparatus discussed in Japanese Patent Application Laid-Open No. 2004-086013 has no pressing member such as a white reference plate at a position opposite the color sensor, so that the high precision measurement cannot be carried out with respect to the patch image.

In a case where the measurement is carried out with the white reference plate being pressed against a measurement object from a back side thereof according to the ISO13655, the high precision measurement can be carried out with respect to the patch image. However, on the other hand, since an attachment/detachment operation of the white reference plate takes time, the productivity is lowered.

On the other hand, in a case where the measurement is carried out without pressing the white reference plate against the measurement object from the back side thereof, the attachment/detachment operation of the white reference plate is no longer needed. Therefore, the productivity would not be lowered but, instead thereof, the measurement accuracy of the patch image is degraded.

SUMMARY OF THE INVENTION

The present invention is directed to an image forming apparatus capable of measuring a patch image (i.e., a measurement image) by using a measurement unit, with good accuracy and satisfactory productivity being provided in response to a demand of users.

According to an aspect of the present invention, an image forming apparatus includes an image forming unit configured to form a measurement image on a recording sheet by using a color material, a fixing unit configured to fix the measurement image onto the recording sheet by heating the measurement image, a measurement unit configured to measure color values of the measurement image fixed on the recording sheet downstream of the fixing unit in a sheet conveyance direction of the recording sheet, a pressing member configured to press the recording sheet, on which the measurement image is formed, against the measurement unit, a selection unit configured to select a mode from among a first mode, in which the measurement image is measured with the pressing member pressing the recording sheet against the measurement unit, and a second mode, in which the measurement image is measured without the pressing member pressing the recording sheet against the measurement unit, and a control unit configured to cause the measurement unit to measure the color values of the measurement image in the mode selected by the selection unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

In an exemplary embodiment of the present invention, a solution of the issue raised above is described below by exemplifying an electrophotographic laser beam printer. The electrophotographic method is employed here as an example of an image forming method. However, the present exemplary embodiment is also applicable to an ink jet method and a dye-sublimation method. This is because the present exemplary embodiment is useful in the image forming apparatus in which a thermochromism phenomenon may occur. In the thermochromism phenomenon, a color value of the measurement object varies according to a temperature. In the ink jet method, used are an image forming unit for forming an image on a recording sheet by ejecting an ink and a fixing unit (i.e., a drying unit) for drying the ink.

Figure 1:
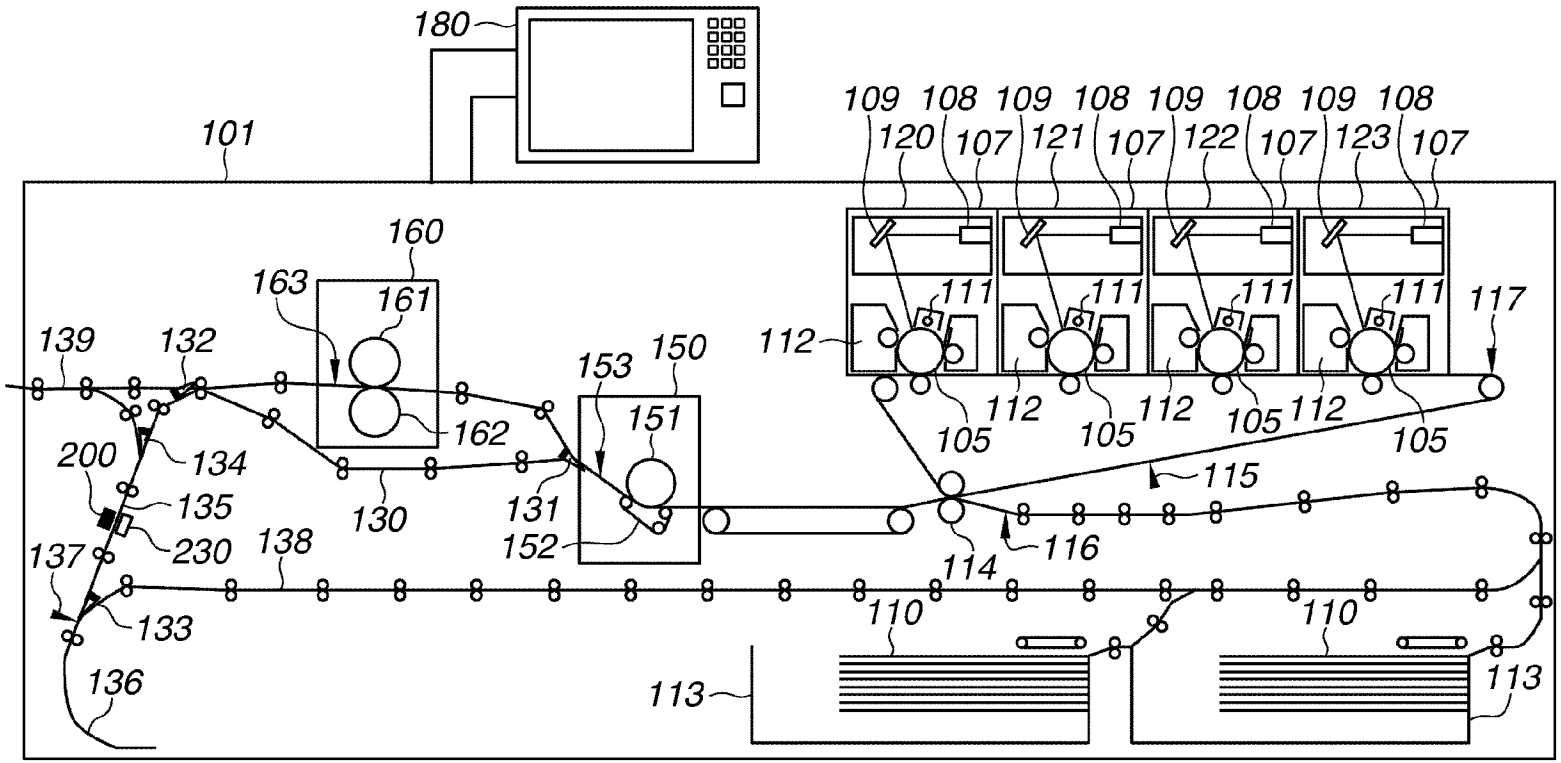
FIG. 1 is a cross sectional view illustrating a configuration of an image forming apparatus.

FIG. 1 is a cross sectional view illustrating a configuration of an image forming apparatus 100. The image forming apparatus 100 is equipped with a housing 101. The housing 101 is provided with systems composing an engine unit and a control board storage unit 104. The control board storage unit 104 stores an engine control unit 102 for conducting a control of each print processing (e.g., sheet feeding processing) performed by each system, and a printer controller 103.

As illustrated in FIG. 1, the engine unit is provided with four stations 120, 121, 122, and 123 respectively corresponding to colors of yellow, magenta, cyan, and black (Y, M, C, and K). The stations 120, 121, 122, and 123 collectively compose an image forming unit for forming an image by transferring a toner to a recoding sheet 110. Each station includes approximately the same members. A photosensitive drum 105 is a kind of an image bearing member having a uniform surface potential charged by a primary charging device 111. A latent image is formed on the photosensitive drum 105 by laser light output from a laser 108. A development unit 112 forms a toner image such that a latent image is developed by using a color material (i.e., a toner). A toner image (i.e., a visible image) is transferred to an intermediate transfer member 106. The visible image formed on the intermediate transfer member 106 is further transferred to the recording sheet 110 conveyed from a sheet storage unit 113 via a transfer roller pair 114.

A fixing process mechanism of the present exemplary embodiment includes a first fixing device 150 and a second fixing device 160 for fixing the toner image transferred to the recording sheet 110 by heating and pressuring the toner image thereon. The first fixing device 150 includes a fixing roller 151 for applying heat to the recording sheet 110, a pressure belt 152 for causing the recording sheet 110 to press-contact against the fixing roller 151, and a first post-fixing sensor 153 for detecting completion of the fixing processing. Each of the rollers has a hollow roller and includes a heater therein.

The second fixing device 160 is disposed downstream of the first fixing device 150 in a sheet conveyance direction of the recording sheet 110. The second fixing device 160 adds gloss to the toner image on the recording sheet 110 fixed by the first fixing device 150 and secures stability of the toner image. The second fixing device 160 also includes, as similar to the first fixing device 150, a fixing roller 161, a pressure roller 162, and a second post-fixing sensor 163. The recording sheet 110 is not required to be passed through the second fixing device 160 depending on a type of the recording sheet 110. In this case, the recording sheet 110 passes through a conveyance path 130 without passing through the second fixing device 160 for the purpose of decrease in energy consumption volume.

For example, in a case where a setting is made such that more gloss is added to the image on the recording sheet 110 or in a case where the recording sheet 110 requires more amount of heat for fixing the image on the thick paper, the recording sheet 110 having passed through the first fixing device 150 is also conveyed to the second fixing device 160. On the other hand, in a case where the recording sheet 110 is a plain paper or a thin paper and in a case where a setting for adding more gloss to the paper is not made, the recording sheet 110 is conveyed through a conveyance path 130 which detours the second fixing device 160. Whether the recording sheet 110 is conveyed to the second fixing device 160 or the recording sheet 110 is conveyed by detouring the second fixing device 160 is controlled by switching a flapper 131.

A conveyance path switching flapper 132 is a guide member for guiding the recording sheet 110 to a sheet discharge path 135 or for guiding the recording sheet 110 to a sheet discharge path 139 for guiding the recording sheet to the outside. A leading edge of the recording sheet 110 guided to the sheet discharge path 135 passes through a reversal sensor 137 to be conveyed to a reversing unit 136. When the reversal sensor 137 detects a trailing edge of the recording sheet 110, a sheet conveyance direction in which the recording sheet 110 is to be conveyed is switched. A conveyance path switching flapper 133 is a guide member for guiding the recording sheet 110 to either one of a two-sided image forming conveyance path 138 or the sheet discharge path 135.

A color sensor 200 for detecting the patch image as the measurement image on the recording sheet 110 is disposed in the sheet discharge path 135. Four color sensors 200 are disposed side by side in a direction perpendicular to the sheet conveyance direction of the recording sheet 110, and thus four-row patch images can be detected. When an instruction for color detection is received from an operation unit 180, the engine control unit 102 executes, for example, a maximum density adjustment, a gradation adjustment, and multi-color correction processing.

A white reference plate 230 is provided at a position opposite each color sensor 200. The conveyance path switching flapper 134 is a guide member for guiding the recording sheet 110 to a sheet discharge path 139 for discharging the recording sheet to the outside. The recording sheet 110 conveyed through the sheet discharge path 139 is discharged to the outside of the image forming apparatus 100.

Figure 2:
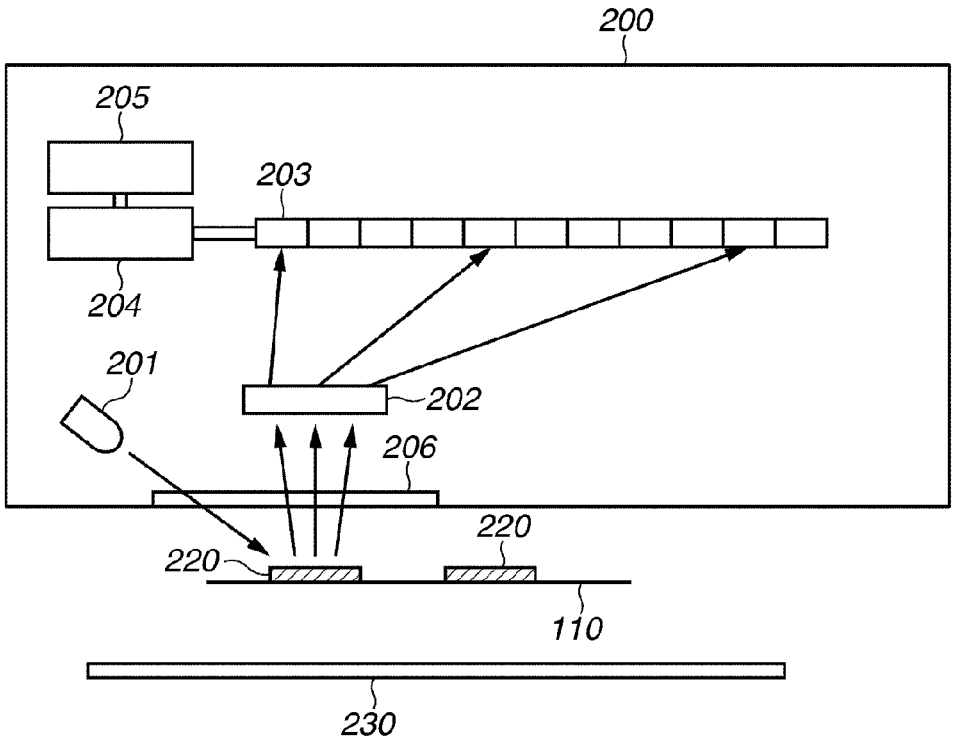
FIG. 2 illustrates a configuration of a color sensor.

FIG. 2 illustrates a configuration of the color sensor 200. The color sensor 200 is provided therein with a white light-emitting diode (LED) 201, a diffraction grating 202, a line sensor 203, a calculation unit 204, and a memory 205. The white LED 201 is a light emitting element for irradiating light to a patch image 220 on the recording sheet 110. The diffraction grating 202 splits light reflected on the patch image 220 by wavelength. The line sensor 203 is a photo-detection element including the n number of light-sensitive elements for detecting light split by wavelength by the diffraction grating 202. The calculation unit 204 performs various calculations based on a light intensity value of each pixel detected by the line sensor 203

A memory 205 stores various types of data to be used by the calculation unit 204. The calculation unit 204 includes, for example, a spectral calculation unit which performs spectral calculation based on the light intensity value, and a Lab calculation unit which calculates a Lab value. The color sensor 200 may further include a lens which condenses light irradiated from the white LED 201 onto the patch image 220 on the recording paper 110 and condenses light reflected on the patch image 220 onto the diffraction grating 202.

According to the regulations of the ISO13655, the white reference plate 230 is provided at a position opposite the color sensor 200. A desirable white reference plate 230 has a high light resistance for suppressing an aged deterioration thereof and has a high strength for the sake of the below described attachment/detachment operation of the white reference plate 230. As a result thereof, for example, the white reference plate 230 made of an aluminum oxide processed with ceramic is used. The white reference plate 230 is provided to each of the four color sensors 200. That is, total four white reference plates 230 are provided.

The white reference plate 230 is provided to be attachable/detachable to a window 206 of the color sensor 200 to serve as a pressing member for pressing the recording sheet 110 against the color sensor 200. More specifically, in a case where the recording sheet 110 is a thin paper, more quantity of light from the color sensor 200 passes through the recording sheet 110 without being reflected on the recording sheet 110, so that a scanned image becomes darker than an actual image. If the recording sheet 110 flutters while the recording sheet 110 is conveyed, a distance between the recording sheet 110 and the color sensor 200 varies, resulting in making an accurate measurement impossible.

To solve the above issue, the patch image 220 is measured with the color sensor 200 such that the white reference plate 230 is pressed against a side of the color sensor 200 from a back side of the recording sheet 110 on which the patch image 220 is formed. Accordingly, the higher precision measurement can be realized.

Figure 3:
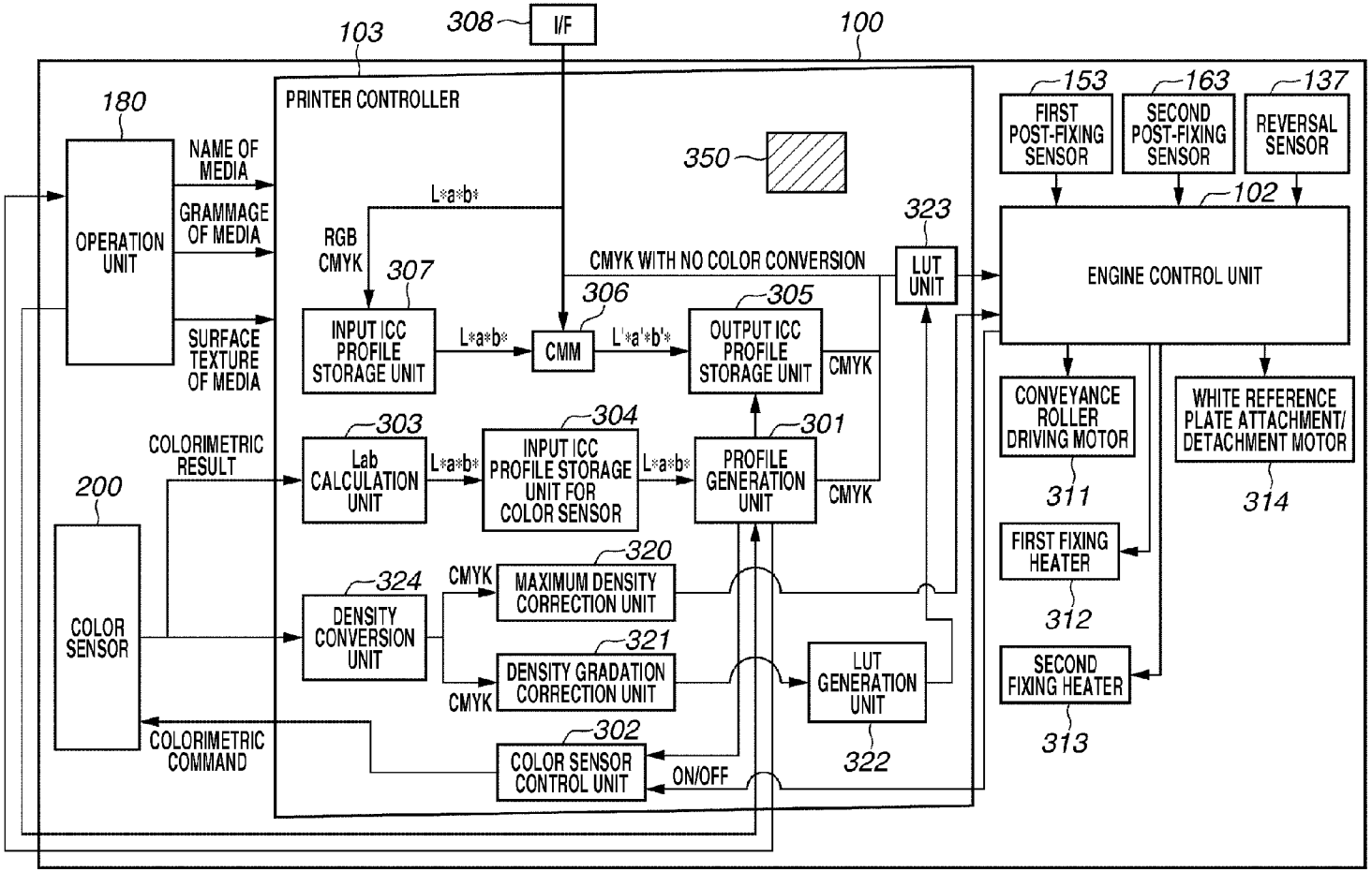
FIG. 3 is a block diagram illustrating a system configuration of the image forming apparatus.

FIG. 3 is a block diagram illustrating a system configuration of the image forming apparatus 100. The maximum density adjustment, the gradation adjustment, and the multi-color correction processing are described below with reference to FIG. 3.

The printer controller 103 includes a central processing unit (CPU), which reads out a program for executing the following flow chart from a storage unit 350 to execute the program. In FIG. 3, for the sake of easy understanding of the processing performed by the printer controller 103, an interior configuration of the printer controller 103 is illustrated by a block diagram.

The printer controller 103 instructs an engine control unit 102 to output a test chart to be used in the maximum density adjustment. At the time, a monochromatic patch image for adjusting the maximum density is formed on the recording paper 110 according to a charged potential, exposure intensity, and a developing bias set preliminarily or set at the time of the last maximum density adjustment. Then, the engine control unit 102 instructs a color sensor control unit 302 to measure colors of the patch image 220.

When the colors of the patch image are measured with the color sensor 200, a result of the color measurement is transmitted to a density conversion unit 324 as spectral reflectance data. The density conversion unit 324 converts the spectral reflectance data into density data of the colors of C, M, Y, and K, and transmits the converted density data to a maximum density correction unit 320.

The maximum density correction unit 320 calculates correction amounts for the charged potential, the exposure intensity, and the developing bias such that the maximum density of the output image becomes a desired value, and transmits the calculated correction amounts to the engine control unit 102. The engine control unit 102 uses the received correction amounts for the charged potential, the exposure intensity, and the developing bias on and after the next image forming operation. According to the above-described operation, the maximum density of the image to be output is adjusted.

When the maximum density adjustment is completed, the printer controller 103 instructs the engine control unit 102 to form a 16-gradation patch image on the recording paper 110. Examples of an image signal of the 16-gradation patch image may include 00H, 10H, 20H, 30H, 40H, 50H, 60H, 70H, 80H, 90H, A0H, B0H, C0H, D0H, E0H, and FFH.

At the time, the 16-gradation patch image is formed on the recording sheet 110 by using the correction amounts for the charged potential, the exposure intensity, and the developing bias calculated in the maximum density adjustment. When the 16-gradation patch image is formed on the recording sheet 110, the engine control unit 102 instructs the color sensor control unit 302 to measure the colors of the patch image 220.

When the colors of the patch image 220 are measured with the color sensors 200, a result of the color measurement is transmitted to the density conversion unit 324 as the spectral reflectance data. The density conversion unit 324 converts the spectral reflectance data into density data of the colors of C, M, Y, and K, and transmits the converted density data to a density gradation correction unit 321. The density gradation correction unit 321 calculates a correction amount for an exposure amount such that a desired gradation can be obtained. A look-up table (LUT) generation unit 322 generates a monochromatic gradation LUT, and transmits the monochromatic gradation LUT to a LUT unit 323 as a signal value of each of the colors of C, M, Y, and K.

Upon performing the multi-color correction processing, the image forming apparatus 100 generates a profile based on the detection result of a plurality of the patch images including multiple colors, and converts an input image by using the profile to form an image thereof to be output. The plurality of patch images including the multiple colors includes a patch image formed such that a halftone dot area ratio of the images of the four colors C, M, Y, and K are varied and the four color images are superposed on one another. The ICC profile, which has recently been accepted in the market, is used here as an example of the profile for realizing an excellent color reproducibility. The present exemplary embodiment, however, may also be applied to the other profiles. The present exemplary embodiment can also be applied to Color Rendering Dictionary (CRD) employed by PostScript (registered mark) Level 2 proposed by Adobe Systems Incorporated, and a color separation table with Adobe Photoshop (registered mark).

When a customer engineer exchanges parts, or before a user executes a job requiring a color matching accuracy, or when the user desires to know a tint of a final output in his design conceptional phase, the engineer or user operates the operation unit 180 to instruct generation of a color profile The printer controller 103 performs the profile generation processing. When the operation unit 180 receives a profile generation command, a profile generation unit 301 outputs a CMYK color chart 210 as an ISO12642 test form to the engine control unit 102 without using the profile. The profile generation unit 301 transmits a color measurement command to the color sensor control unit 302. The engine control unit 102 controls the image forming apparatus 100 to cause the image forming apparatus 100 to execute charge processing, expose processing, development processing, transfer processing, and fixing processing. Accordingly, the ISO12642 test form is formed on the recording sheet 110. The color sensor control unit 302 controls the color sensors 200 to measure the colors of the ISO12642 test form. The color sensor 200 outputs spectral reflectance data as the measurement result thereof on a Lab calculation unit 303 of the printer controller 103. The Lab calculation unit 303 converts the spectral reflectance data into L*a*b* data to output the L*a*b* data on the profile generation unit 301. The Lab calculation unit 303 may convert the spectral reflectance data into a Commission Internationale de l'Eclairage (CIE) 1931XYZ color specification system having a device-independent color space signal.

The profile generation unit 301 generates an output ICC profile based on a relationship between CMYK color signals output on the engine control unit 102 and the L*a*b* data input from the Lab calculation unit 303. The profile generation unit 301 stores thus generated output ICC profile replaced the output ICC profile currently stored in the output ICC profile storage unit 305.

The ISO12642 test form includes patches of color signals of the colors C, M, Y, and K covering a color reproduction range where a typical copy machine can output colors. Thus, the profile generation unit 301 creates a color conversion table based on a relationship between a color signal value of each of the colors and the measured L*a*b* data value. That is, a conversion table for converting color signals of the colors C, M, Y and K into the Lab value is generated. A reverse conversion table is generated based on the conversion table.

When the profile generation unit 301 receives a profile generation command from a host computer via an interface (I/F) 308, the profile generation unit 301 outputs the generated output ICC profile on the host computer via the I/F 308. The host computer can execute the color conversion corresponding to the ICC profile with an application program.

In the color conversion in a normal color output, an image signal, which is input from a scanner unit via the I/F 308 on the assumption of RGB (Red, Green, and Blue) signal values and CMYK signal values in standard printing colors such as JapanColor, is transmitted to an input ICC profile storage unit 307 which receives input from external devices. The input ICC profile storage unit 307 converts the RGB signals into the L*a*b* data or the CMYK signals into the L*a*b* data according to the image signal input via the I/F 308. The input ICC profile stored in the input ICC profile storage unit 307 includes a plurality of LUTs.

Examples of the LUTs include a one-dimensional LUT for controlling a gamma value of the input signal, a multi-color LUT called as a direct mapping, and a one-dimensional LUT for controlling the gamma value of thus generated conversion data. The input image signal is converted from a color space dependent on a device into the L*a*b* data independent from the device with the LUTs.

The image signal converted into L*a*b* chromaticity coordinates is input into a color management module (CMM) 306. The CMM 306 executes various types of color conversions. For example, the CMM 306 executes a gamut conversion in which mapping of a mismatch is performed between a scanning color space such as a scanner unit as an input device and an output color reproduction range of the image forming apparatus 100 as an output device. The CMM 306 further executes a color conversion for adjusting a mismatch between a type of light source at the time of input and a type of light source at the time of observing an output object (the mismatch is also referred to as a mismatch of a color temperature setting).

As described above, the CMM 306 converts the L*a*b* data into L'*a'*b'* data to output the converted data to an output ICC profile storage unit 305. A profile generated according to the color measurement is stored in the output ICC profile storage unit 305. Thus, the output ICC profile storage unit 305 performs a color conversion of the L'*a'*b'* data by using a newly generated ICC profile to further convert the resulting data into the signals of the colors C, M, Y, and K dependent on an output device.

The LUT unit 323 corrects gradation of the signals of the colors C, M, Y, and K by means of the LUT to be described bellow set by the LUT generation unit 322. The signals of the colors C, M, Y, and K of which gradation is corrected are output to the engine control unit 102.

Figure 4:
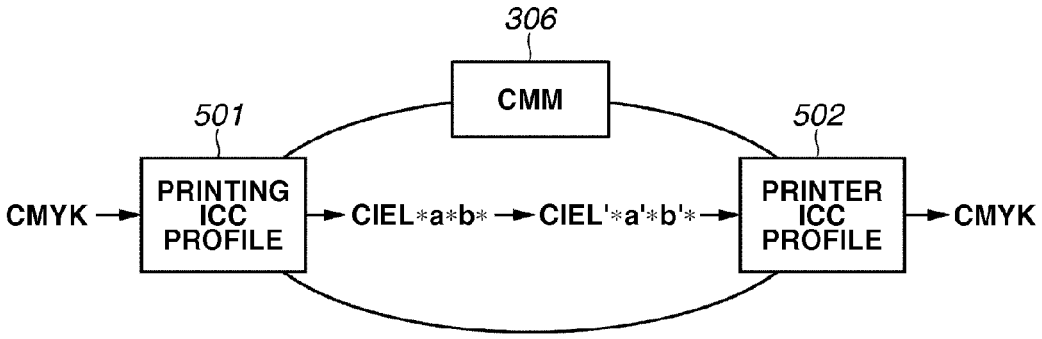
FIG. 4 is a schematic diagram illustrating a color management environment.

In FIG. 3, the CMM 306 is independent from an input ICC profile storage unit 307 and an output ICC profile storage unit 305. However, as illustrated in FIG. 4, the CMM 306 performs a color management. More specifically, the CMM 306 performs a color conversion by using an input profile (i.e., a printing ICC profile 501) and an output profile (i.e., a printer ICC profile 502).

Figure 5:
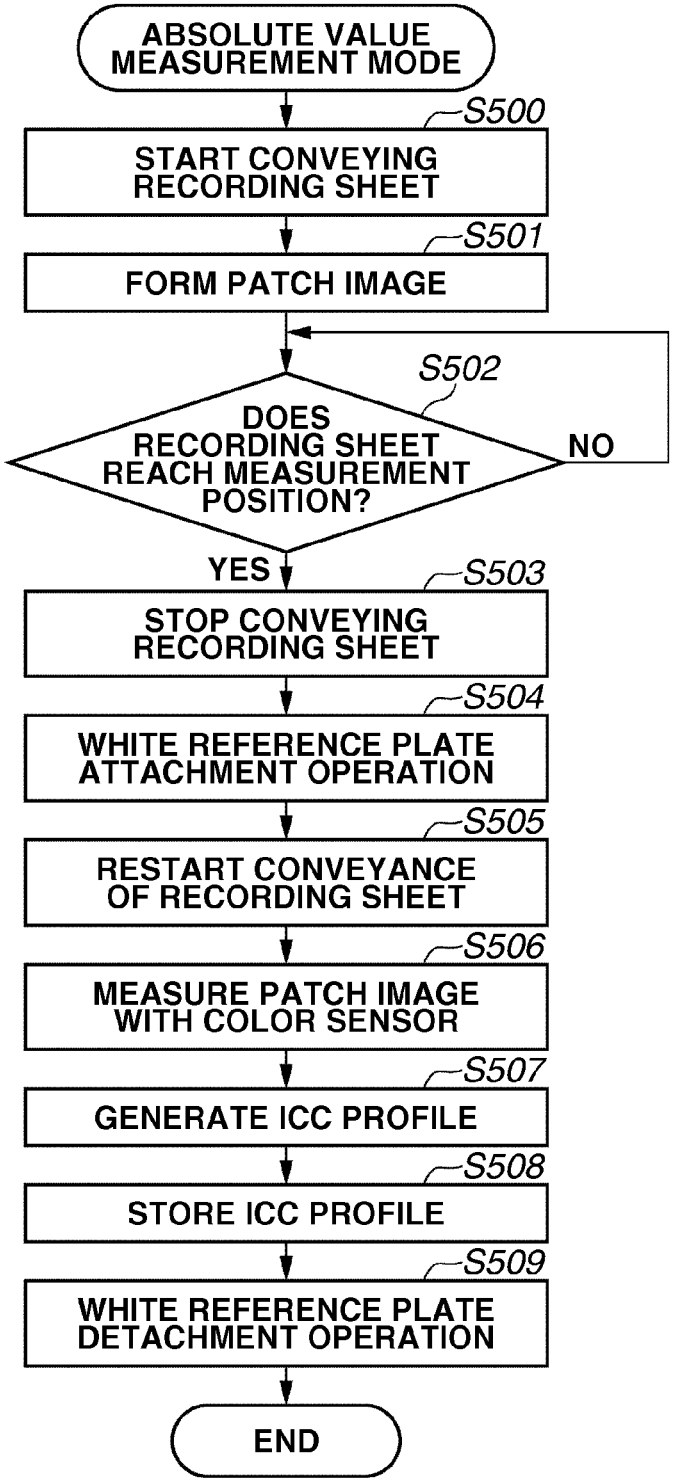
FIG. 5 is a flow chart illustrating an operation of the image forming apparatus in an absolute value measurement mode.

FIG. 5 is a flow chart illustrating an operation of the image forming apparatus 100 in an absolute value measurement mode.

The flow chart is executed by the printer controller 103. The image forming apparatus 100 is controlled by the engine control unit 102 according to an instruction from the printer controller 103. The processing of the present flow chart is executed according to an instruction from the operation unit 180.

In step S500, the printer controller 103 starts conveying the recording sheet 110 from the sheet storage unit 113. In step S501, the printer controller 103 forms the patch image 220 on the recording sheet 110.

In step S502, the printer controller 103 waits for the leading edge of the recording sheet 110 to be detected based on the output from the color sensors 200. The printer controller 103 always monitors the output from the color sensors 200 to detect a time at which incoming quantity of light increases as reaching time of the leading edge of the recording sheet 110. A sensor for detecting the leading edge of the recording sheet 110 may be newly provided here.

When detecting the leading edge of the recording sheet 110 (YES in step S502), then in step S503, the printer controller 103 stops driving a conveyance roller driving motor 311 to thereby stop the conveyance of the recording sheet 110. In step S504, the printer controller 103 drives a white reference plate attachment/detachment motor 314 to cause the white reference plate 230 to be attached to the window 206 of each of the color sensors 200.

When completing the attachment/detachment operation, then in step S505, the printer controller 103 drives the conveyance roller driving motor 311 to restart conveying the recording sheet 110. In step S506, the printer controller 103 uses the color sensors 200 to measure color values of the patch image 220 on the recording sheet 110.

In step S507, the printer controller 103 generates an ICC profile based on the measurement result according to the above-described method. In step S508, the printer controller 103 causes the generated ICC profile to be stored in the storage unit 350. In step S509, the printer controller 103 drives the white reference plate attachment/detachment motor 314 to cause the white reference plate 230 to be detached from the window 206 of each of the color sensors 200. Then, the control processing of the flow chart is ended.

When executing the absolute value measurement mode, it is desirable to perform the processing of the present flow chart after the above-described maximum density adjustment operation and gradation adjustment operation.

Figure 6:
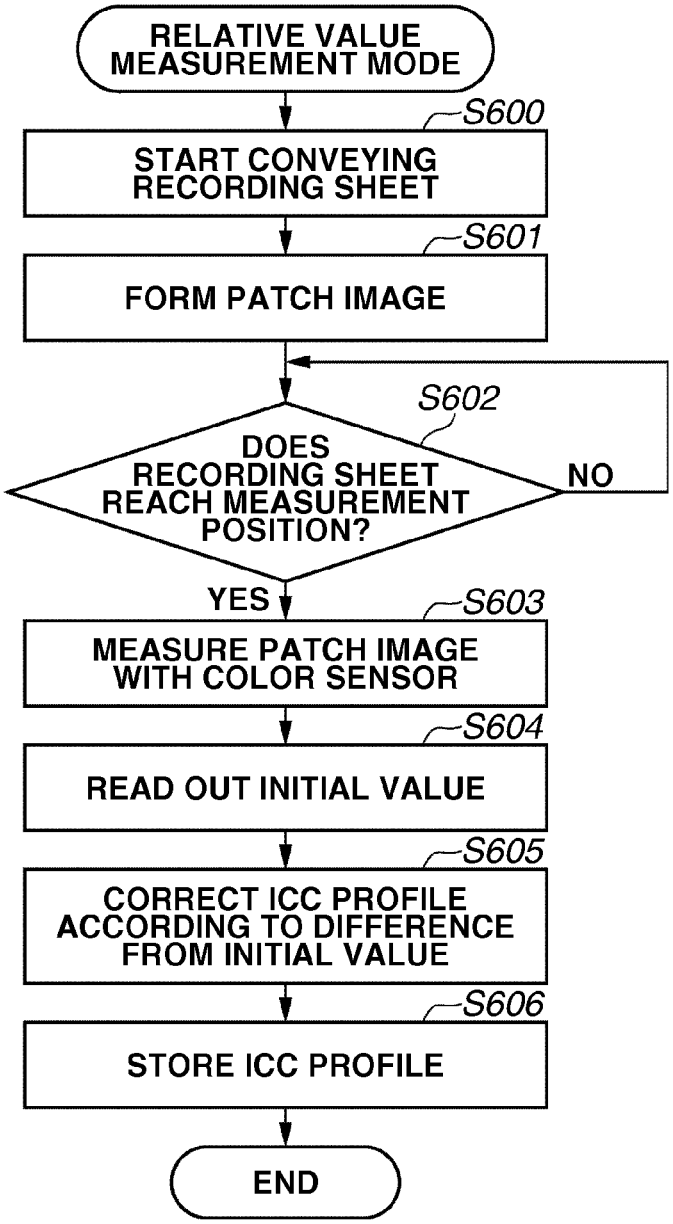
FIG. 6 is a flow chart illustrating an operation of the image forming apparatus in a relative value measurement mode.

FIG. 6 is a flow chart illustrating an operation of the image forming apparatus 100 in a relative value measurement mode.

The flow chart is executed by the printer controller 103. The image forming apparatus 100 is controlled by the engine control unit 102 according to an instruction of the printer controller 103. The processing of the present flow chart is executed according to an instruction from the operation unit 180.

In the relative value measurement mode, the ICC profile is corrected based on a difference between a previously obtained measurement value (i.e., an initial value) of each color sensor 200 and a current measurement value of the corresponding color sensor 200 (i.e., a relative value). In the relative value measurement mode, different from the absolute value measurement mode, the white reference plate 230 is not attached to the window 206 of each color sensor 200. Thus, measurement accuracy is degraded but the productivity can be improved because the attachment/detachment operation is not required in the relative value measurement mode.

The color values of the patch image 220 detected while the white reference plate 230 is left detached immediately after the execution of the absolute value measurement mode are used as initial values to be used in the relative value measurement mode. The initial values are stored in the storage unit 350.

In step S600, the printer controller 103 starts conveying the recording sheet 110 from the sheet storage unit 113. In step S601, the printer controller 103 forms the patch image 220 on the recording sheet 110.

In step S602, the printer controller 103 waits for the leading edge of the recording sheet 110 to be detected based on the output from the color sensors 200. The printer controller 103 keeps monitoring the output from the color sensors 200 and detects the time at which the incoming quantity of light increases as the reaching time of the leading edge of the recording sheet 110. A sensor for detecting the leading edge of the recording sheet 110 may be newly provided.

When detecting the leading edge of the recording sheet 110 (YES in step S602), then in step S603, the printer controller 103 measures the color values of the patch image 220 on the recording sheet 110 by using the color sensors 200. At the time, the measurement is carried out by each color sensor 200 while the white reference plate 230 is left detached therefrom.

In step S604, the printer controller 103 reads out the initial values of the color values of the patch image 220 from the storage unit 350. In step S605, the printer controller 103 corrects the ICC profile according to the shifted amount (i.e., the difference) between the measurement values measured in step S603 and the initial values read out in step S604. In step S606, thus corrected ICC profile is stored in the storage unit 350.

In the above-described absolute value measurement mode and relative value measurement mode, the multi-color correction by using the ICC profile is exemplified for the sake of description. However, they may also be applied to the above-described maximum density adjustment or gradation adjustment.

As described-above, in the present exemplary embodiment, a mode can be selected from either one of the absolute value measurement mode, in which the measurement of the patch image 220 is carried out while the white reference plate 230 is attached to each color sensor 200, and the relative value measurement mode, in which the measurement of the patch image 220 is carried out while the white reference plate 230 is detached from each color sensor 200. Thus, the measurement is carried out by using the color sensors 200 based on the selected mode to determine the image forming conditions (i.e., the ICC profile), for which the image forming operation is performed based on the measurement result. With the above-described configuration of the present exemplary embodiment, the measurement of the patch image 220 by using the color sensors 200 can be carried out responding to the demands for the good accuracy and the satisfactory productivity demanded by the users.

In recitations of the claims attached hereto, a first mode corresponds to the absolute value measurement mode and a second mode corresponds to the relative value measurement mode, respectively.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-275017 filed Dec. 15, 2011, which is hereby incorporated by reference herein in its entirety.

What is claimed is:

1. An image forming apparatus comprising:

an image forming unit configured to form a measurement image on a recording sheet by using a color material;

a fixing unit configured to fix the measurement image onto the recording sheet by heating the measurement image;

a measurement unit configured to measure color values of the measurement image fixed on the recording sheet downstream of the fixing unit in a sheet conveyance direction of the recording sheet;

a pressing member configured to press the recording sheet, on which the measurement image is formed, against the measurement unit;

a selection unit configured to select a mode from among a first mode, in which the measurement image is measured with the pressing member pressing the recording sheet against the measurement unit, and a second mode, in which the measurement image is measured without the pressing member pressing the recording sheet against the measurement unit; and a control unit configured to cause the measurement unit to measure the color values of the measurement image in the mode selected by the selection unit.

2. The image forming apparatus according to claim 1, wherein the pressing member includes a white reference plate provided at a position opposite the measurement unit.

3. The image forming apparatus according to claim 1, wherein the control unit sets, in the first mode, image forming conditions to be used in the adjustment of an image formed by the image forming unit based on a result of the measurement obtained by the measurement unit, and wherein the control unit corrects, in the second mode, the image forming conditions set in the first mode, based on a difference between the result of the measurement obtained by the measurement unit and a result of the previous measurement.

4. The image forming apparatus according to claim 1, wherein the control unit detects, in the second mode, the result of the measurement obtained by the measurement unit as a relative value to the result of the previous measurement.

5. The image forming apparatus according to claim 1, wherein the measurement unit irradiates light onto the measurement image to receive reflection light from the measurement image, so that the measurement unit outputs a spectral reflectance of the measurement image.

6. The image forming apparatus according to claim 5, further comprising:

a first calculation unit configured to calculate a density value based on the spectral reflectance; and a second calculation unit configured to calculate color values based on the spectral reflectance.

7. The image forming apparatus according to claim 6, wherein a wavelength region of the spectral reflectance to be used when the first calculation unit calculates the density value of the measurement image is narrower than a wavelength region of the spectral reflectance to be used when the second calculation unit detects the color values of the measurement image.

8. The image forming apparatus according to claim 1, wherein the image forming unit forms a monochromatic measurement image for detecting the density value, whereas the image forming unit forms a multicolor measurement image for detecting the color values.

9. The image forming apparatus according to claim 1, wherein the image forming unit forms the image on the recording sheet by transferring a toner onto the recording sheet, and wherein the fixing unit fixes the toner to the recording sheet by heating the toner.

10. A method for controlling an image forming apparatus, the image forming apparatus including:

an image forming unit configured to form a measurement image on a recording sheet by using a color material;

a fixing unit configured to fix the measurement image onto the recording sheet by heating the measurement image;

a measurement unit configured to measure the measurement image fixed on the recording sheet downstream of the fixing unit in a sheet conveyance direction of the recording sheet; and a pressing member configured to press the recording sheet, on which the measurement image is formed, against the measurement unit, the method comprising:

selecting a mode from among a first mode, in which the measurement image is measured with the pressing member pressing the recording sheet against the measurement unit, and a second mode, in which the measurement image is measured without the pressing member pressing the recording sheet against the measurement unit; and measuring color values of the measurement image by the measurement unit in the selected mode.

11. The method according to claim 10, wherein the pressing member includes a white reference plate provided at a position opposite the measurement unit.

12. The method according to claim 10, wherein, in the first mode, image forming conditions to be used in adjustment of an image to be formed by the image forming unit are set based on a result of the measurement obtained by the measurement unit, and wherein, in the second mode, the image forming conditions set in the first mode are corrected based on a difference between the result of the measurement obtained by the measurement unit and a result of the previous measurement.

13. The method according to claim 10, wherein the result of the measurement obtained by the measurement unit in the second mode is detected as a relative value to the result of the previous measurement.

14. The method according to claim 10, wherein the measurement unit irradiates light onto the measurement image to receive reflection light from the measurement image, so that the measurement unit outputs a spectral reflectance of the measurement image.

15. The method according to claim 14, further comprising:

calculating a density value based on the spectral reflectance; and calculating color values based on the spectral reflectance.

16. The method according to claim 15, wherein a wavelength region of the spectral reflectance used when the density value is calculated is narrower than a wavelength region of the spectral reflectance used when the color values are calculated.

17. The method according to claim 10, wherein the image forming unit forms a monochromatic measurement image for detecting a density value, whereas the image forming unit forms a multicolor measurement image for detecting color values.

18. The method according to claim 10, wherein the image forming unit forms the image by transferring a toner onto the recording sheet, and wherein the fixing unit fixes the toner to the recording sheet by heating the toner.

* * * * *